United States Patent [19]

Kurek et al.

[11] Patent Number: 4,544,796

[45] Date of Patent: Oct. 1, 1985

[54] SOLVENT EXTRACTION OF AROMATIC COMPOUNDS USING ALKYLSULFOXIDE SOLVENTS

[75] Inventors: Paul R. Kurek, Schaumburg; Dusan J. Engel, Des Plaines; Richard L. Fergin, Mount Prospect, all of Ill.

[73] Assignee: UOP Inc., Des Plaines, Ill.

[21] Appl. No.: 630,909

[22] Filed: Jul. 13, 1984

Related U.S. Application Data

[63] Continuation-in-part of Ser. No. 457,545, Jan. 12, 1983, abandoned.

[51] Int. Cl.[4] ..... C10G 21/16; C10G 21/22

[52] U.S. Cl. ..... 585/856; 208/322

[58] Field of Search ..... 208/322; 585/856

[56] References Cited

U.S. PATENT DOCUMENTS

| | | | |
|---|---|---|---|
| 2,365,898 | 12/1944 | Morris et al. | 505/856 X |
| 2,383,768 | 8/1945 | Buis et al. | 208/322 |
| 2,615,057 | 10/1952 | Wolff et al. | 208/322 |
| 2,658,038 | 11/1953 | Proell | 568/36 X |
| 2,831,039 | 4/1958 | Nevitt | 585/856 |
| 2,849,514 | 8/1958 | Nevitt | 585/856 |
| 2,921,648 | 1/1960 | Wetterhdm et al. | 585/856 X |
| 3,005,032 | 9/1961 | Makin, Jr. | 585/856 |
| 3,356,755 | 12/1967 | Beckham | 585/856 X |

*Primary Examiner*—D. E. Gantz
*Assistant Examiner*—Glenn A. Caldarola
*Attorney, Agent, or Firm*—Thomas K. McBride; William H. Page, II; Raymond H. Nelson

[57] ABSTRACT

Dialkyldisulfinyl-, dialkyldisulfonyl- or alkylsulfinylalkylsulfonylalkanes in which the alkyl portion of the compound contains from 1 to about 10 carbon atoms and the alkane portion of the radical contains from about 3 to about 30 carbon atoms may be used as extraction solvents in liquid/liquid extraction processes whereby aromatic compounds may be separated from a mixture of aromatic compounds and other hydrocarbons.

21 Claims, No Drawings

SOLVENT EXTRACTION OF AROMATIC COMPOUNDS USING ALKYLSULFOXIDE SOLVENTS

CROSS-REFERENCE TO RELATED APPLICATION

This application is a continuation-in-part of our copending application Ser. No. 457,545 filed Jan. 12, 1983, now abandoned, all teachings of which are incorporated herein with reference thereto.

BACKGROUND OF THE INVENTION

In the chemical industry it is necessary, in many instances, that relatively pure compounds be employed as starting materials in chemical reactions. It is therefore necessary to separate desirable chemical compounds from a mixture of other chemical compounds in which the aforesaid desired compounds are present. As an example of this, in some refining operations aromatic compounds are derived from certain processes. The main synthesis routes for the processes of these aromatics usually comprise reformed naphthas and hydrogenated pyrolysis gasolines. However, the aromatic compounds such as benzene, toluene, and the isomeric xylenes are present in admixture with other nonaromatic hydrocarbons such as paraffins or cycloparaffins. In order to recover the desired aromatic compounds in relatively pure form, it was necessary to effect a fractional distillation of the mixture. However, the separation of aromatics from the conventional sources usually could not be effected by a conventional distillation inasmuch as the nonaromatic hydrocarbons present in the feeds possess boiling points which may be within the same boiling range as that of the aromatics. In addition, many of the nonaromatic hydrocarbons present in the mixture have a tendency to form azeotropes with the aromatic compounds, thus contributing to the difficulty of separation. When utilizing distillation procedures for the separation, losses of the aromatic compounds were relatively high and the product purity was low. Therefore, the demand for these aromatic compounds as intermediates in the production of other materials was limited by the low purity of the compounds as well as limited availability.

As was hereinbefore set forth, high grade or high purity aromatic compounds are utilized as intermediates in the preparation of many compounds which are used in the commercial world today. Pure aromatic compounds such as benzene, toluene and the xylenes comprise primarily feedstocks in the petrochemical industry, particularly the plastic and synthetic fiber industry. For example, benzene may be used as the intermediate in the preparation of styrene which itself finds use in the production of many plastics. Likewise, benzene is used as an intermediate in the preparation of phenol, synthetic detergents, Nylon intermediates, aniline, insecticides, fumigants, as well as in motor fuels for upgrading the octane number thereof. Toluene also finds use as a high octane blending stock for gasolines, as a solvent for paints and coatings, gums, resins, in medicines, dyes, perfumes, saccharine, explosives, etc.; while xylenes may be used also as a blending agent for gasoline such as aviation gasoline with individual or specific xylenes such as paraxylene being used in the synthesis of terephthalic acid, for the production of synthetic resins and fibers such as Dacron, Mylar, Terylene, etc.

In order to obtain the aromatic compounds in a desirable state of purity, a liquid/liquid extraction for the separation of aromatics as a class from other hydrocarbons was developed. Various solvents have been employed in this extraction process. A major requirement for the selection of a solvent for the recovery of aromatics from mixtures of hydrocarbons containing these desired compounds involves the relationship of solubility between aromatic compounds and nonaromatic compounds such as paraffins and cycloparaffins. Various solvents have been employed to effect this liquid/liquid separation, however, the characteristics of these solvents with respect to aromatic selectivity/solubility are widely varied. When effecting the extraction process, it is possible to alter the solubility characteristics of the solvent by controlling the operating parameters under which the extraction is effected. However, if the solubility characteristic is allowed to become too high, the selectivity becomes too low for the required separation to be effected cleanly and efficiently, thus resulting in excessive processing requirements and equipment which is in a position downstream of the extractor. The practical effects which may result when utilizing a solvent which possesses the most desirable characteristics will include a lower solvent circulation rate than is required when utilizing other solvents to give the same separation efficiency, thus resulting in a lowering of utility requirements and a reduction in investment costs inasmuch as the equipment throughput in the solvent circulation section is decreased as compared to other solvents. Another practical consideration which is to be considered is the initial cost of the solvent itself.

Heretofore, one solvent which has been employed in a highly efficient manner to effect a liquid/liquid extraction of aromatic compounds from hydrocarbon mixtures is sulfolane which is tetrahydrothiophene-1,1-dioxide. However, the cost of sulfolane is relatively high when compared to other solvents which may be obtained by utilizing starting materials which are less costly, thus resulting in an overall lower cost of the desired solvent material.

It has now been discovered that other solvents comprising aliphatic sulfoxides which possess a specific configuration of the type hereinafter set forth in greater detail may be utilized as solvent extractants for the separation of aromatic compounds from nonaromatic compounds. The fact that these particular sulfoxides possess the desirable characteristics which enable them to be employed as solvent extractants was unexpected in view of the inability of other aliphatic sulfoxides to act as solvent extractants, the differences in solvent extractability and selectivity being hereinafter set forth in greater detail. The particular solvents of the present invention which comprise dialkyldisulfinyl-, dialkyldisulfonyl- or alkylsulfinylalkylsulfonylalkanes may be prepared from starting materials which are relatively inexpensive, the alkanes possessing desirable characteristics such as a relatively high specific gravity, a low specific heat, a low melting point as well as a boiling point which is higher than that of the heaviest aromatic compounds which are to be extracted from mixtures of hydrocarbons.

BRIEF SUMMARY OF THE INVENTION

This invention relates to a process for the solvent extraction of aromatic compounds. More specifically, the invention is concerned with a process for the solvent extraction of aromatic compounds from mixtures of aromatic compounds and other hydrocarbons utilizing, as the solvent, a particular type of an alkylsulfoxide compound. As was previously discussed, the separation of aromatic compounds from mixtures of aromatic and nonaromatic compounds must be effected in such a manner so that the recovered aromatic compounds possess a high degree of purity, thus enabling the aromatic compounds to be used as intermediates in the preparation of various compounds. In order to attain this goal and accomplish the separation in a relatively inexpensive manner, it is necessary to employ certain solvents for the extraction of aromatic compounds from hydrocarbon mixtures which possess high selectivity. The thus recovered aromatic compounds which possess a purity high enough to enable the compound to be used as an intermediate in various chemical reactions such as the production of phthalic anhydride from orthoxylene, the manufacture of terephthalic acid or dimethyl terephthalide from para-xylene to produce polyester fibers, or the production of polyester resins from meta-xylene. In addition, the solvents of the present invention may also be used as selective extractants for metal salts, as chelating agents, flotation agents, components for drilling muds, for die assists, for surface active agents, etc.

It is therefore an object of this invention to provide a process for the recovery of aromatic compounds.

A further object of this invention is to provide a process for the solvent extraction of aromatic compounds from mixtures of aromatic compounds and nonaromatic compounds utilizing certain alkyl sulfoxides as solvent extractants.

In one aspect an embodiment of this invention resides in a process for the solvent extraction of an aromatic compound from a mixture of said aromatic compound and other hydrocarbons which comprises treating said mixture with a solvent selected from the group consisting of compounds having the generic formulae:

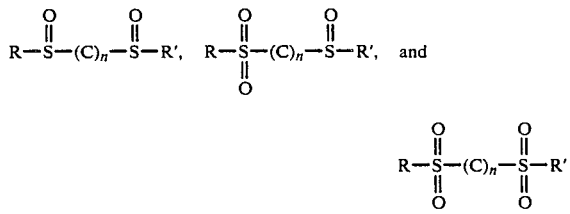

in which R and R′ are alkyl radicals containing from about 1 to 10 carbon atoms and n is an integer of from 3 to about 30 carbon atoms at extraction conditions, and recovering the purified aromatic compound.

A specific embodiment of this invention is found in a process for the solvent extraction of an aromatic compound such as benzene from a mixture of benzene and methylcyclopentane which comprises treating said mixture with a solvent comprising 1,3-diethyldisulfinyl propane at a temperature in the range of from about 75° to about 150° C. and a pressure in the range of from about atmospheric to about 50 atmospheres, and recovering the resultant purified benzene.

Other objects and embodiments will be found in the following detailed description of the invention.

DETAILED DESCRIPTION OF THE INVENTION

As hereinbefore set forth, the present invention is concerned with a process for the solvent extraction of an aromatic compound from a mixture of aromatic compounds and other hydrocarbons including nonaromatic compounds utilizing as the solvent therefor an alkylsulfoxide compound having a particular configuration hereinafter set forth in greater detail. The desired alkylsulfoxide compound which comprises dialkyldisulfinyl-, dialkyldisulfonyl- or alkylsulfinylalkylsulfonylalkane may be prepared by employing starting materials which are relatively inexpensive and therefore commercially attractive. The process is effected by treating a dialkyldithioalkane with an oxidizing agent in the presence of suitable solvents of a type hereinafter set forth in greater detail. By utilizing certain solvents which heretofore have not been generally accepted for use in oxidations due to their tendency to oxidize, giving by-products difficult to remove from the reaction mixture, it is possible, however, in our invention to effect the oxidation reaction at a relatively rapid rate with a concomitant easy work-up and recovery of the desired product. The dialkyldithioalkanes which are subjected to the oxidation reaction are those in which the alkyl moiety of the compound contains from 1 to about 10 carbon atoms, while the alkane moiety of the compound contains from 3 to about 30 carbon atoms. Some representative examples of such compounds which may be oxidized will include 1,3-dimethyldithiopropane, 1,3-diethyldithiopropane, 1,3-diisopropyldithiopropane, 1,3-dibutyldithiopropane, 1,3-dipentyldithiopropane, 1,3-dihexyldithiopropane, 1,3-diheptyldithiopropane, 1,4-diisopropyldithiobutane, 1,4-dibutyldithiobutane, 1,4-dipentyldithiobutane, 1,4-dioctyldithiobutane, 1,4-dinonyldithiobutane, 1,5-diisopropyldithiopentane, 1,5-dibutyldithiopentane, 1,5-dioctyldithiopentane, 1,5-dinonyldithiopentane, 1,5-didecyldithiopentane, 1,6-dimethyldithiohexane, 1,6-diethyldithiohexane, 1,6-diisopropyldithiohexane, 1,6-dibutyldithiohexane, 1,7-dimethyldithioheptane, 1,7-diethyldithioheptane, 1,8-dimethyldithiooctane, 1,8-diethyldithiooctane, 1,10-dimethyldithiodecane, 1,10-diethyldithiodecane, 1,10-diisopropyldithiodecane, etc. It is to be understood that the aforementioned list of dialkyldithioalkanes is only representative of the type of compounds which may be oxidized and that the present invention is not necessarily limited thereto.

The aforesaid dialkyldithioalkanes may be prepared by utilizing relatively available compounds. For example, one method of preparing the dialkyldithioalkane is to react a halo-substituted alkane such as 1,2-dichloroethane, 1,2-dibromoethane, 1,3-dibromopropane, 1,4-dichlorobutane, 1,4-dibromobutane with a mercaptan salt to form the desired compound. A second method of obtaining the desired compound would be to treat an olefin or diolefin such as ethylene, allene, or 1,3-butadiene with a mercaptan such as ethylene mercaptan, n-propyl mercaptan, or isopropyl mercaptan to form the dialkyldithioalkane.

The oxidation of the aforesaid dialkyldithioalkane is effected by treating the compound with an oxidation agent under oxidation conditions in the presence of a suitable solvent. In the preferred embodiment of the invention, the oxidizing agent which is employed comprises hydrogen peroxide, although it is also contemplated within the scope of this invention that any other oxidizing agent known in the art may be employed to afford the desired product. Reaction conditions which are employed in the process include subambient temperatures in order to obtain a good yield of the desired product. Generally speaking, reaction temperatures which are utilized in the present process will range from about 0° up to about 50° C., the reaction temperature being maintained by the utilization of cooling devices such as coils, ice baths, etc. The solvents which are employed in this reaction are selected from the group consisting of acetic acid, methanol and acetone, the latter two being unexpectedly efficient as the solvent due to the generally accepted premise that when these solvents are utilized, slow rates of oxidation usually occur.

The oxidizing agent such as hydrogen peroxide which is utilized will be present in the reaction mixture in an amount sufficient to prepare either the sulfinyl, sulfonyl, or sulfinyl-sulfonyl product. Generally speaking, when a disulfinyl or a sulfinyl-sulfonyl product is desired, the hydrogen peroxide oxidizing agent will be present in the reaction mixture in a mole ratio in the range of from about 2:1 to about 3:1 moles of oxidizing agent per mole of dialkyldithioalkane. Likewise, when a disulfonyl product is desired, the oxidizing agent will be present in a mole excess, generally in a range of from about 4:1 to about 6:1 moles of oxidizing agent per mole of dialkyldithioalkane. Likewise, the solvent which is employed will be present in a mole ratio in the range of from about 5:1 to about 20:1 moles of solvent per mole of dialkyldithioalkane compounds.

The process for preparing the desired extractant compounds comprising a disulfinyl-, disulfonyl-, or sulfinyl-sulfonylalkane may be effected in any suitable manner and may comprise either a batch or continuous type operation. For example, when a batch type operation is employed, predetermined amounts of the dialkyldithioalkane and oxidizing solvent are placed in an appropriate apparatus. One type of apparatus which may be used comprises a flask provided with a stirrer, thermometer, condenser and dropping funnel, said flask being immersed in or surrounded by cooling means such as an ice bath or coils. The oxidizing agent such as hydrogen peroxide is slowly added to the apparatus through the dropping funnel for a predetermined period of time while maintaining the temperature of the reaction in a subambient range. As was hereinbefore set forth, the amount of oxidizing agent which is charged to the apparatus is determinant on whether a sulfinyl, sulfonyl or mixed product is desired. Upon completion of the predetermined reaction time which may be in a range of from about 1 to about 10 hours or more in duration, the reaction mixture is recovered, separated from the solvent and neutralized by the addition of a basic compound such as sodium hydroxide, potassium hydroxide, sodium bicarbonate, potassium bicarbonate, etc. The neutralized product is then extracted with a solvent, dried and recovered.

Alternatively, a continuous method of operation may be employed to obtain the desired compound. When such a type of operation is employed, a quantity of the dialkyldithioalkane in the oxidizing solvent is continuously charged to a reaction which is maintained at the proper operating conditions. The oxidizing agent is also continuously added through separate means and, after permitting the oxidation reaction to occur for a predetermined period of time, the reactant effluent is continuously discharged from the reactor. The reaction mixture is then subjected to conventional means of recovery similar in nature to those hereinbefore set forth, that is, by separation from the solvent, neutralization, extraction, etc. whereby the desired product is recovered while any unreacted starting materials and the oxidizing solvent are also recovered and recycled back to the reactor to form a portion of the feedstock.

The extraction solvents which are used for the separation of aromatic compounds from mixtures of aromatic compounds and other hydrocarbons will possess the generic formulae:

$$R-\overset{O}{\overset{\|}{S}}-(C)_n-\overset{O}{\overset{\|}{S}}-R',\quad R-\underset{O}{\underset{|}{S}}-(C)_n-\overset{O}{\overset{\|}{S}}-R',\quad \text{and}$$

$$R-\underset{O}{\overset{O}{\overset{\|}{\underset{|}{S}}}}-(C)_n-\underset{O}{\overset{O}{\overset{\|}{\underset{|}{S}}}}-R'$$

in which R and R′ are alkyl radicals containing from about 1 to 10 carbon atoms and n is an integer of from 3 to about 30 carbon atoms.

Some specific examples of the dialkyldisulfinyl-, dialkyldisulfonyl-, or alkylsulfinyl-alkylsulfonylalkanes which may be prepared according to the aforementioned processes and which may be used as an extraction solvent according to the process of this invention will include: 1,3-dimethyldisulfinylpropane, 1,3-diethyldisulfinylpropane, 1,3-diisopropyldisulfinylpropane, 1,3-di-sec-butyldisulfinylpropane, 1,3-di-n-pentyldisulfinylpropane, 1,3-di-n-hexyldisulfinylpropane, 1,3-di-n-heptyldisulfinylpropane, 1,3-di-n-decyldisulfinylpropane, 1,4-dimethyldisulfinylbutane, 1,4-diethyldisulfinylbutane, 1,4-diisopropyldisulfinylbutane, 1,4-di-sec-butyldisulfinylbutane, 1,4-di-n-pentyldisulfinylbutane, 1,4-di-n-pentyldisulfinylbutane, 1,4-di-n-hexyldisulfinylbutane, 1,4-di-n-heptyldisulfinylbutane, 1,4- di-n-decyldisulfinylbutane, 1,5-dimethyldisulfinylpentane, 1,5-diethyldisulfinylpentane, 1,5-diisopropyldisulfinylpentane, 1,5-di-sec-butyldisulfinylpentane, 1,5-di-n-pentyldisulfinylpentane, 1,5-di-n-hexyldisulfinylpentane, 1,5-di-n-heptyldisulfinylpentane, 1,5-di-n-decyldisulfinylpentane, 1,10-dimethyldisulfinyldecane, 1,10-diethyldisulfinyldecane, 1,10-diisopropyldisulfinyldecane, 1,10-di-sec-butyldisulfinyldecane, 1,10-di-n-pentyldisulfinyldecane, 1,10-di-n-hexyldisulfinyldecane, 1,10-di-n-heptyldisulfinyldecane, 1,10-di-n-decyldisulfinyldecane, 1,3-dimethyldisulfonylpropane, 1,3-diethyldisulfonylpropane, 1,3-diisopropyldisulfonylpropane, 1,3-di-sec-butyldisulfonylpropane, 1,3-di-n-pentyldisulfonylpropane, 1,3-di-n-hexyldisulfonylpropane, 1,3-di-n-heptyldisulfonylpropane, 1,3-di-n-decyldisulfonylpropane, 1,4-dimethyldisulfonylbutane, 1,4-diethyldisulfonylbutane, 1,4-diisopropyldisulfonylbutane, 1,4-di-sec-butyldisulfonylbutane, 1,4-di-n-pentyldisulfonylbutane, 1,4-di-n-pentyldisulfonylbutane, 1,4-di-n-hexyldisulfonylbutane, 1,4-di-n-heptyldisulfonylbutane, 1,4-di-n-decyldisulfonylbutane, 1,5-dimethyldisulfonylpentane, 1,5-diethyldisulfonylpentane, 1,5-diisopropyldisulfonylpentane, 1,5-di-sec-butyldisulfonylpentane, 1,5-di-n-pentyldisulfonylpentane, 1,5-di-n-hexyldisulfonylpentane, 1,5-di-n-heptyldisulfonylpentane, 1,5-di-n-decyldisulfonylpentane, 1,10-dimethyldisulfonyldecane, 1,10-diethyldisulfonyldecane, 1,10-diisopropyldisulfonyldecane, 1,10-di-sec-butyldisulfonyldecane, 1,10-di-n-pentyldisulfonyldecane, 1,10-di-n-hexyldisulfonyldecane, 1,10-di-n-heptyldisulfonyldecane, 1,10-di-n-decyldisulfonyldecane, 1-methylsulfinyl-3-methylsulfonylpropane, 1-ethylsulfinyl-3-ethylsulfonylpropane, 1-isopropylsulfinyl-3-isopropylsulfonylpropane, 1-ethylsulfinyl-3-isopropylsulfonylpropane, 1-isopropylsulfinyl-3-ethylsulfonylpropane, 1-butylsulfinyl-3-butylsulfonylpropane, 1-octylsulfinyl-3-octylsulfonylpropane, 1-decylsulfinyl-3-decylsulfonylpropane, 1-methylsulfinyl-5-methylsulfonylpentane, 1-ethylsulfinyl-5-ethylsulfonylpentane, 1-isopropylsulfinyl-5-isopropylsulfonylpentane, 1-butylsulfinyl-5-butylsulfonylpentane, 1-pentylsulfinyl-5-pentylsulfonylpentane, 1-octylsulfinyl-5-octylsulfonylpentane, 1-decylsulfinyl-b 5-decylsulfonylpentane, 1-methylsulfinyl-6-methylsulfonylhexane, 1-ethylsulfinyl-6-ethylsulfonylhexane, 1-isopropylsulfinyl-6-isopropylsulfonylhexane, 1-butylsulfinyl-6-butylsulfonylhexane, 1-pentylsulfinyl-6-pentylsulfonylhexane, 1-octylsulfinyl-6-octylsulfonylhexane, 1-decylsulfinyl-6-decylsulfonylhexane, 1-methylsulfinyl-10-ethylsulfonyldecane, 1-ethylsulfinyl-10-ethylsulfonyldecane, 1-isopropylsulfinyl-10-isopropylsulfonyldecane, 1-butylsulfinyl-10-butylsulfonyldecane, 1-pentylsulfinyl-10-pentylsulfonyldecane, 1-octylsulfinyl-10-octylsulfonyldecane, 1-decylsulfinyl-10-decylsulfonyldecane, etc. It is to be understood that the aforementioned dialkyldisulfinyl-, dialkyldisulfonyl- and alkylsulfinyl-alkylsulfonylalkanes are only representative of the class of compounds which may be used as extraction solvents, and that the present invention is not necessarily limited thereto.

The following examples are given for the purpose of illustrating the use of extraction solvents of the present invention. However, it is to be understood that these examples are merely illustrative in nature and that the present process is not necessarily limited thereto.

EXAMPLE I

A method of preparing the dialkyldithioalkane was effected by placing 46 grams (2 moles) of sodium dissolved in 1000 ml of absolute ethyl alcohol in a 2-liter 3-neck flask which was equipped with a magnetic stirrer, thermometer, nitrogen inlet, reflux condenser and a dropping funnel. After placing the sodium and alcohol in the flask, 124 grams (2.0 moles) of ethyl mercaptan was added and the reaction mixture was heated to reflux temperature for a period of 9.5 hours. Thereafter, 201 grams (0.996 mole) of 1,3-dibromopropane was added to the refluxing solution, a precipitate of sodium bromide immediately forming. The mixture was then refluxed for a period of 5 hours and allowed to equilibrate for an additional period of 16 hours. The mixture was then filtered and the solid was washed on the filter with 3 portions of 100 cc of ethyl alcohol. Following this, the reaction mixture was poured into 5 liters of distilled water and extracted with ether. The ether layers were dried over anhydrous sulfate and subjected to distillation, first at atmospheric pressure to remove the ether, then at reduced pressure to remove the ethyl alcohol, and finally under a high vacuum (1.1 mm mercury) to yield 156 grams of 1,3-diethyldithiopropane which had a boiling point of 75°/77° C. at 1.1 mm Hg. The yield was 96%.

The diethyldithiopropane (32.0 grams) which was prepared according to the above paragraph along with 96.6 grams of glacial acetic acid and 33 ml of methylene chloride were placed in a 500 ml 3-neck flask which was equipped with a magnetic stirrer, thermometer and dropping funnel, said flask being immersed in an ice bath which maintained the temperature at about 5° C. An oxidizing agent comprising 44.5 grams of a 29.7% hydrogen peroxide solution was added dropwise with stirring over a two hour period, while maintaining the temperature in a range of from about 4° to about 6° C. The mixture was stirred and thereafter was allowed to slowly warm to ambient temperature. Following this, the contents were poured into 150 ml of water and neutralized with 135 grams of sodium bicarbonate. The resulting mixture was extracted with 6 portions of chloroform (350 ml) and dried over anhydrous magnesium sulfate. The chloroform was evaporated and the remainder which comprised 38 grams of solid was crystallized from 275 ml of acetone. The product comprised 30.0 grams of 1,3-diethyldisulfinylpropane which had a melting point in a range of from 94° to 107° C., the wide melting point range being due to the various isomers of the product. The yield was 78.5%.

EXAMPLE II

In this example, 10.2 grams of 1,3-diethyldithiopropane which was prepared in a manner similar to that set forth in Example I above was placed in a 500 ml beaker along with 87.5 grams of acetic acid. Following this, 66.7 grams of a 29.7% hydrogen peroxide solution was added during a period of 10 minutes, following which the mixture was evaporated on a steam bath for seven hours. The solid which was recovered from the evaporation was dissolved in 1500 ml of boiling ethyl alcohol, cooled to room temperature, and further cooled in an ice bath. The mixture was then filtered and air dried, yielding 13.43 grams of 1,3-diethyldisulfonylpropane which had a melting point of 182° to 186° C., the yield being 94.4%.

EXAMPLE III

In this example, 74.88 grams (0.39 moles) of 1,3-diisopropyldithiopropane along with 194 grams (3.22 moles) of glacial acetic acid were placed in a 1-liter 3-neck round bottom flask equipped with a magnetic stirrer, thermometer, condenser and dropping funnel. Thereafter, 89 grams (0.78 mole) of a 30% hydrogen peroxide solution was charged to the dropping funnel and was slowly added dropwise during a period of approximately two hours while maintaining a reaction temperature of approximately 20° C. by means of ice bath cooling. The reaction was allowed to proceed for an additional period of four hours. After recovery of the reaction mixture, the glacial acetic acid was stripped and the remainder was neutralized with 270 grams (3.22 moles) of sodium bicarbonate. The neutralized product was extracted with chloroform, dried over magnesium sulfate, filtered and washed with chloroform. Chloroform was then distilled off to yield 62.3 grams of 1,3-diisopropyldisulfinylpropane in a yield of 71.3%.

EXAMPLE IV

To illustrate the use of other solvents, 20 grams (0.14 mole) of 1,3-diisopropyldithiopropane (which had been prepared from the reaction of sodium ethoxide and isopropyl mercaptan plus 1,3-dibromopropane) and 78 grams (2.43 moles) of methanol were placed in a 500 ml flask which was similarly equipped to the flask described in Example III above. The flask was immersed in an ice bath and 23.6 grams (0.2083 mole) of hydrogen peroxide was slowly added to the mixture during a period of two hours while maintaining the temperature at about 20° C. Upon completion of the addition of the hydrogen peroxide, the reaction was stirred for an additional period of one hour following which the methanol was stripped by distillation at a temperature of 60° C. and a pressure of 30 psig vacuum. The product was then neutralized with sodium bicarbonate, extracted with chloroform, dried with magnesium sulfate, filtered and again washed with chloroform to give a yield of 26.6 grams (84.2%).

Another sample of product was obtained by placing 20 grams of 1,3-diisopropyldithiopropane and 80 grams of acetone in a flask which was immersed in an ice bath. Thereafter, 23.6 grams of hydrogen peroxide was added dropwise from the dropping funnel during a period of two hours while maintaining the temperature at approximately 10° C. Upon completion of the addition, the reaction was stirred for an additional period of 0.5 hours and the acetone was stripped under similar conditions to those hereinbefore set forth. The product was again neutralized with sodium bicarbonate, extracted with chloroform, dried over magnesium sulfate, filtered and again washed with chloroform. The product comprised 23.2 grams of 1,3-diisopropyldisulfinylpropane and a yield of 73.5%.

If so desired, the sulfonyl product, that is, 1,3-diisopropyldisulfonylpropane, may be prepared by utilizing an excess of hydrogen peroxide over that which was employed to prepare the sulfinyl product, similar reaction conditions and sulfates being employed to produce the desired product.

EXAMPLE V

To illustrate the ability of these compounds to act as solvents in a liquid/liquid extraction reaction, a hydrocarbon test mixture was prepared which comprised 23 wt. % of benzene in methylcyclopentane. A 3 oz. tube type vessel was used in the extract step, approximately 7 grams of 1,3-diethyldisulfinylpropane and 7 grams of the hydrocarbon mixture being placed in the vessel. The vessel was immersed in an oil bath which was maintained at a temperature of 121° C. for a period of two hours, the vessel being removed several times during this period to thoroughly mix the contents thereof by shaking. At the end of the two hour period, the reaction mixture was allowed to disengage into two layers. The upper layer was withdrawn into an iced round bottom flask containing deionized water and the lower solvent layer was also withdrawn into a second iced round bottom flask. The weights of the liquids were recorded and the flask containing the lower layer was attached to a distillation column. The layer was distilled into an iced receiver and after maintaining an overhead temperature of about 97° C. for a period of 30 minutes, the hydrocarbon from the receiver was drained into an iced bottle. The net weights of all hydrocarbons including that removed from the upper layer were recorded and both upper and lower layer were analyzed by means of gas chromatography. Calculation of all the values determined there had been a Beta selectivity of 3.74, the selectivity being determined by the wt. % of benzene in the lower layer divided by the methylcyclopentane in the lower layer, this value being divided by the weight % of the benzene in the upper layer divided by the weight % of the methylcyclopentane in the upper layer. In addition to the K value which is the final evaluation of a solvent with respect to its efficiency in the separation of benzene from the methylcyclopentane contained in any hydrocarbon mixture consisting of at least these two components was 19.4.

In addition, the 1,3-diisopropyldisulfinylpropane may also exhibit similar characteristics of selectivity and K values when used as a solvent in a liquid/liquid extraction whereby aromatics are separated from other hydrocarbons such as paraffins.

EXAMPLE VI

As a further illustration of the unexpected activity of compounds of the present invention to act as extraction solvents for aromatic compounds, especially in view of the supposition that an increase in the length of the carbon chain would decrease the selectivity towards the extraction of aromatic compounds, a test similar to that set forth in Example V above was run. A mixture of benzene and methylcyclopentane similar to that hereinbefore set forth was subjected to an extraction utilizing, as the extraction solvent, a mixture of n-propylsulfoxide plus 2% water. The extraction was performed at a temperature of 120° C. for a period of 30 minutes. However, at the end of the test period, only one phase was obtained, no extraction of the aromatic benzene being accomplished. In addition, after cooling the reaction mixture to 23° C., no separation into two layers was observed.

When the above experiment was repeated using a mixture of n-propylsulfoxide plus 10% water at 120° C., only one phase was obtained. When cooling the mixture to 23° C., the reaction mixture disengaged into two phases. The lower phase or extractant was subjected to gas chromatographic analysis which disclosed that less than 1% of the benzene was extracted. Therefore, it was impossible to obtain any meaningful calculation of the Beta selectivity or the K value.

The results of this test taken in conjunction with the references as exemplified by those set forth in the *J. Appl. Chem. Biotechnol.* 1976, 26, pages 247–252 and 425–435 which indicate that an aliphatic sulfoxide did not perform well as an extractant for aromatics, graphically illustrates the unexpected discovery that certain aliphatic sulfoxides such as dialkyldisulfinyl-, dialkyldisulfonyl- and alkylsulfinylalkylsulfonylalkanes exhibit relatively good extractant abilities as well as selectivities to the aromatic compounds.

We claim as our invention:

1. A process for the solvent extraction of an aromatic compound from a mixture of said aromatic compound and other hydrocarbons which comprises treating said mixture with a solvent selected from the group consisting of compounds having the generic formulae:

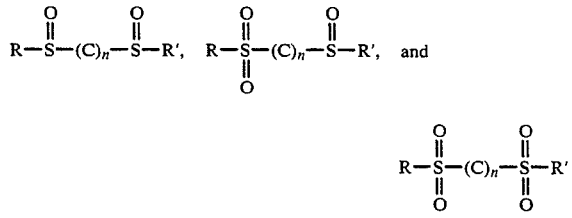

in which R and R′ are alkyl radicals containing from about 1 to 10 carbon atoms and n is an integer of from 3 to about 30 carbon atoms at extraction conditions, and recovering the purified aromatic compound.

2. The process as set forth in claim 1 in which said extraction conditions include a temperature in the range of from about 75° to about 150° C. and a pressure in the range of from about atmospheric to about 50 atmospheres.

3. The process as set forth in claim 1 in which said aromatic compound is benzene and said other hydrocarbons are a mixture of paraffins.

4. The process as set forth in claim 1 in which said aromatic compound is toluene and said other hydrocarbons are a mixture of paraffins.

5. The process as set forth in claim 1 in which said aromatic compound is xylene and said other hydrocarbons are a mixture of paraffins.

6. The process as set forth in claim 1 in which said solvent is a dialkyldisulfinylalkane.

7. The process as set forth in claim 6 in which said dialkyldisulfinylalkane is 1,3-diisopropyldisulfinylpropane.

8. The process as set forth in claim 6 in which said dialkyldisulfinylalkane is 1,3-diethyldisulfinylpropane.

9. The process as set forth in claim 6 in which said dialkyldisulfinylalkane is 1,4-diisopropyldisulfinylbutane.

10. The process as set forth in claim 6 in which said dialkyldisulfinylalkane is 1,5-dipentyldisulfinylpentane.

11. The process as set forth in claim 1 in which said solvent is an alkylsulfinylalkylsulfonylalkane.

12. The process as set forth in claim 11 in which said alkylsulfinylalkylsulfonylalkane is 1-isopropylsulfinyl-3-isopropylsulfonylpropane.

13. The process as set forth in claim 11 in which said alkylsulfinylalkylsulfonylalkane is 1-isopropylsulfinyl-4-isopropylsulfonylbutane.

14. The process as set forth in claim 11 in which said alkylsulfinylalkylsulfonylalkane is 1-pentylsulfinyl-3-pentylsulfonylpropane.

15. The process as set forth in claim 11 in which said alkylsulfinylalkylsulfonylalkane is 1-ethylsulfinyl-5-ethylsulfonylpentane.

16. The process as set forth in claim 1 in which said solvent is dialkyldisulfonylalkane.

17. The process as set forth in claim 16 in which said dialkyldisulfonylalkane is 1,3-diethyldisulfonylpropane.

18. The process as set forth in claim 16 in which said dialkyldisulfonylalkane is 1,3-diisopropyldisulfonylpropane.

19. The process as set forth in claim 16 in which said dialkyldisulfonylalkane is 1,4-diisopropyldisulfonylbutane.

20. The process as set forth in claim 16 in which said dialkyldisulfonylalkane is 1,5-dibutyldisulfonylpentane.

21. The process as set forth in claim 16 in which said dialkyldisulfonylalkane is 1,8-diisopropyldisulfonyloctane.

* * * * *